US008695712B2

(12) United States Patent
Urquhart et al.

(10) Patent No.: US 8,695,712 B2
(45) Date of Patent: Apr. 15, 2014

(54) WELLHEAD TREE PRESSURE COMPENSATING DEVICE

(75) Inventors: Alexander Urquhart, Aberdeen (GB); William D. Munro, Aberdeen (GB)

(73) Assignee: Vetco Gray Inc., Houston, TX (US)

( * ) Notice: Subject to any disclaimer, the term of this patent is extended or adjusted under 35 U.S.C. 154(b) by 612 days.

(21) Appl. No.: 12/980,994

(22) Filed: Dec. 29, 2010

(65) Prior Publication Data

US 2012/0168173 A1 Jul. 5, 2012

(51) Int. Cl.

| | |
|---|---|
| ***E21B 33/035*** | (2006.01) |
| ***E21B 33/043*** | (2006.01) |
| ***E21B 34/04*** | (2006.01) |
| ***E21B 23/04*** | (2006.01) |
| ***E21B 33/134*** | (2006.01) |

(52) U.S. Cl.
USPC ..... 166/368; 166/360; 166/381; 166/192

(58) Field of Classification Search
USPC ..... 166/360, 368, 381, 192; 137/67
See application file for complete search history.

(56) References Cited

U.S. PATENT DOCUMENTS

| | | | | | |
|---|---|---|---|---|---|
| 793,128 | A * | 6/1905 | Gardner | 166/303 |
| 1,050,557 | A * | 1/1913 | McLaughlin | 166/182 |
| 1,843,002 | A * | 1/1932 | Davis | 166/192 |
| 2,053,448 | A * | 9/1936 | Starr | 166/153 |
| 2,214,226 | A * | 9/1940 | English | 166/277 |
| 2,687,179 | A * | 8/1954 | Dismukes | 166/177.5 |
| 2,815,817 | A * | 12/1957 | Conrad | 277/333 |
| 2,884,071 | A * | 4/1959 | Fredd | 166/137 |
| 3,099,318 | A * | 7/1963 | Miller et al. | 166/227 |
| 3,166,124 | A * | 1/1965 | Johnson | 166/368 |
| 3,378,080 | A * | 4/1968 | Fredd | 166/156 |
| 3,581,816 | A * | 6/1971 | Malone | 166/187 |
| 3,685,544 | A * | 8/1972 | Ball et al. | 138/90 |
| 5,868,204 | A * | 2/1999 | Pritchett et al. | 166/368 |
| 5,884,706 | A * | 3/1999 | Edwards | 166/335 |
| 6,394,131 | B1 * | 5/2002 | Fross et al. | 137/614.05 |
| 6,450,263 | B1 * | 9/2002 | Schwendemann | 166/373 |
| 6,648,075 | B2 * | 11/2003 | Badrak et al. | 166/381 |
| 6,695,051 | B2 * | 2/2004 | Smith et al. | 166/134 |
| 6,832,649 | B2 * | 12/2004 | Bode et al. | 166/278 |
| 6,896,052 | B2 * | 5/2005 | Simpson et al. | 166/207 |
| 7,104,323 | B2 * | 9/2006 | Cook et al. | 166/278 |
| 7,159,669 | B2 * | 1/2007 | Bourgoyne et al. | 166/382 |
| 7,168,494 | B2 * | 1/2007 | Starr et al. | 166/379 |
| 7,493,956 | B2 * | 2/2009 | Shaw et al. | 166/292 |

(Continued)

FOREIGN PATENT DOCUMENTS

| | | | |
|---|---|---|---|
| EP | 2270309 A2 | 1/2011 | |
| FR | 2693784 A1 * | 1/1994 | F16K 7/07 |
| GB | 2401165 B | 1/2006 | |

OTHER PUBLICATIONS

GB Partial Search Report dated Mar. 7, 2012 from corresponding Application No. GP1121856.7.

*Primary Examiner* — Matthew Buck
*Assistant Examiner* — Edwin Toledo-Duran
(74) *Attorney, Agent, or Firm* — Bracewell & Giuliani LLP

(57) ABSTRACT

A pressure mitigating device is used to reduce pressure in a void within a wellhead housing. In one embodiment, the pressure mitigating device includes two plates that define a void between them. Increased pressure in the wellhead housing causes the plates to elastically displace towards each other. The plates contact each other, limiting the displacement prior to plastic deformation.

20 Claims, 4 Drawing Sheets

(56) References Cited

U.S. PATENT DOCUMENTS

| | | | | |
|---|---|---|---|---|
| 7,543,648 | B2 * | 6/2009 | Hill et al. | 166/369 |
| 7,647,973 | B2 * | 1/2010 | Minassian et al. | 166/338 |
| 7,753,115 | B2 * | 7/2010 | Zupanick | 166/106 |
| 7,789,158 | B2 * | 9/2010 | Zupanick | 166/370 |
| 8,056,618 | B2 * | 11/2011 | Wagner et al. | 166/57 |
| 8,064,142 | B2 * | 11/2011 | Batchko et al. | 359/665 |
| 8,220,550 | B2 * | 7/2012 | Dunn et al. | 166/351 |
| 8,230,928 | B2 * | 7/2012 | Cuiper et al. | 166/338 |
| 8,240,392 | B2 * | 8/2012 | Barnard et al. | 166/386 |
| 2002/0056553 | A1 * | 5/2002 | Duhon et al. | 166/302 |
| 2002/0139539 | A1 * | 10/2002 | Hoffman et al. | 166/381 |
| 2003/0000710 | A1 * | 1/2003 | Turley et al. | 166/386 |
| 2005/0189104 | A1 * | 9/2005 | Turley et al. | 166/134 |
| 2007/0034379 | A1 * | 2/2007 | Fenton et al. | 166/368 |
| 2009/0139720 | A1 * | 6/2009 | Frazier | 166/295 |
| 2009/0166045 | A1 * | 7/2009 | Wetzel et al. | 166/381 |
| 2010/0208357 | A1 * | 8/2010 | Batchko et al. | 359/666 |
| 2012/0186828 | A1 * | 7/2012 | Lively et al. | 166/381 |

* cited by examiner

WELLHEAD TREE PRESSURE COMPENSATING DEVICE

BACKGROUND OF THE INVENTION

1. Field of the Invention

The present invention relates in general to a method and apparatus to mitigate trapped pressure in a wellhead and in particular to a compressible pressure limiting device for limiting pressure from a void typically located between two crown plugs in a wellhead tree system.

2. Brief Description of Related Art

A horizontal subsea tree has a production outlet extending generally horizontally, in relation to the wellbore, and a bore that is axially aligned with the wellbore. A tubing hanger lands in the horizontal tree and supports a string of tubing extending into the wellbore. The tubing hanger has a vertical passage and a lateral passage extending from the vertical passage and registering with the production outlet of the tree. In some installations an internal tree cap lands in the tree above the tubing hanger, the tree cap normally having a vertical passage that aligns with the vertical passage in the tubing hanger. As a dual safety barrier, a wireline deployed crown plug is installed in the vertical passage of the tubing hanger and another crown plug is installed in the vertical passage of the tree cap. In other installations, the internal tree cap is omitted. In that case, the vertical passage of the tubing hanger is typically plugged with two crown plugs to meet requirements of having dual safety barriers.

Fluid, such as, for example, completion fluid, may be trapped in the vertical passage between the two plugs. The fluid may be relatively cold when it is trapped because the subsea temperature is relatively cold. During production, the well fluid flowing through portions of the wellhead is at a higher temperature and subsequently heats the subsea wellhead. As the fluid trapped between the crown plugs heats up and is restricted from expanding, the trapped fluid pressure can potentially increase above the working pressure of the crown plugs and, thus, damage the integrity of the crown plugs. It is thus desirable to limit the pressure in the void between the crown plugs, without releasing the fluid trapped between the plugs into the environment.

SUMMARY OF THE INVENTION

A pressure compensating device can be used to mitigate the pressure increase that can occur when fluid tries to thermally expand in a confined space. In one embodiment, the pressure compensator is located in a wellhead assembly that has a cylindrical bore, a first plug located in and sealingly engaging the cylindrical bore and a second plug located in and sealingly engaging the cylindrical bore. The second plug can be spaced axially apart from the first plug, and thus the cylindrical bore, the first plug, and the second plug define a cavity. Trapped fluid can be retained in the cavity. To mitigate the pressure increase, a pressure compensator having a pair of plates (a first plate and a second plate) can be located within the cavity. The pair of plates can define a void between them and a compressible fluid can be located within the void. When the volume of the wellbore fluid in the cavity increases, it can cause the plates to deflect inward, toward each other.

The inward deflection of the first plate, into the void, can be limited by the second plate such that the first plate does not plastically deform prior to being so limited by the second plate. In one embodiment, the inward deflection of the second plate, into the void, is limited by the first plate such that the second plate does not plastically deform prior to being so limited by the first plate. A cylindrical ring can connect the first plate and second plate and thus define an outer diameter of the void. One or both plates can have a concave surface in relaxed state. Alternatively, one or both plates can have a generally flat surface in its relaxed state. The plates can be made of any of a variety of materials including, for example, metal, polymer, or elastomer. The void between the plates can be filled with a compressible fluid including, for example, a gas such as air, nitrogen, or argon. In one embodiment, the void can be at negative pressure, less than atmospheric pressure, when the plates are in their relaxed state.

The compensator assembly can be located in a frame, or cage, that can be placed in the cavity. The frame can have a sidewall with an aperture so that wellbore fluid can pass through the aperture, into the frame, and thus reach the surface of the compensator plates. More than one compensator can be located in the cavity and, indeed, more than one compensator can be located in a single frame. If more than one compensator is used, a gap can exist between the plates of the two compensators so that wellbore fluid can reach the exterior surfaces of those plates.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
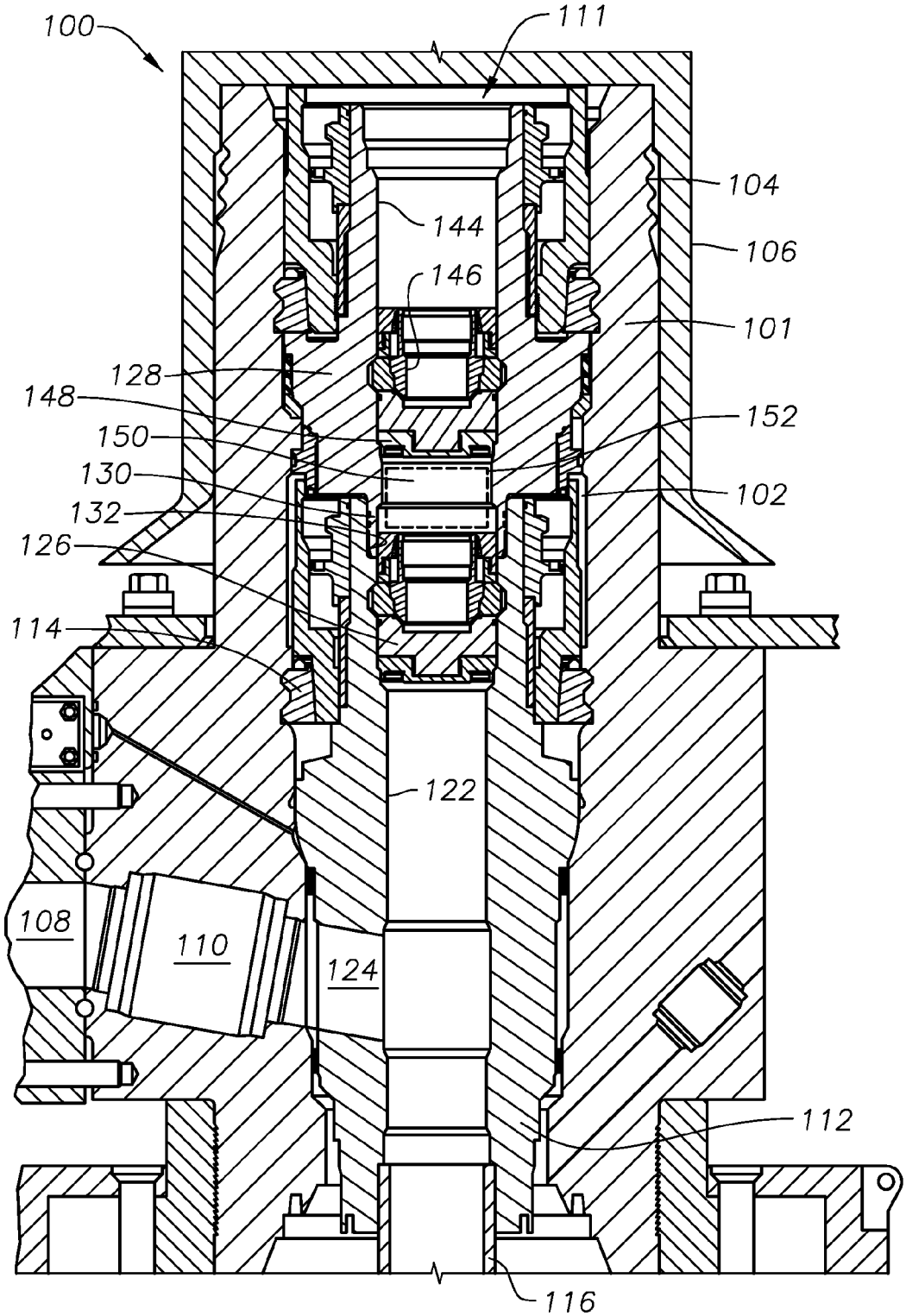
FIG. 1 is a sectional view of a subsea horizontal tree having an exemplary embodiment of a pressure compensating device.

Referring to FIG. 1, Christmas tree 100 is of a type known as a horizontal tree. It has a tree block 101 with a vertical or axial tree bore 102 extending completely through it. A set of grooves 104 is located on the exterior near the upper end for connection to a drilling riser (not shown). A removable corrosion cover 106 fits over the upper end of tree 100. Tree 100 has a lateral production passage 108 that extends generally horizontally from bore 102 and is controlled by a valve 110. Tree 100 will be landed on top of a wellhead housing (not shown), which supports casing extending into a well.

The tree 100 has an inner wellhead assembly 111 housed within the axial bore 102 of the tree 100. A tubing hanger 112 lands sealingly in bore 102. Tubing hanger 112 is secured to tree 100 by a lock down mechanism 114. A string of production tubing 116 extends through the casing hangers (not shown) into the well for the flow of production fluid. Production tubing 116 is secured to tubing hanger 112 and communicates with a vertical passage 122 that extends through tubing hanger 112. A lateral passage 124 extends from vertical passage 122 and aligns with tree lateral passage 108.

A lower wireline retrievable plug 126, or crown plug, will lock in vertical passage 122 above lateral passage 124, sealing the upper end of vertical passage 122. Seals can form a seal between plug 126 and tubing hanger 112, and dogs, or other types of locking devices, may be used to lock plug 126 in place. In this example, a tree cap 128 inserts sealingly into tree bore 102 above tubing hanger 112. Tree cap 128 has a downward depending isolation sleeve 130 that is coaxial. Sleeve 130 fits within a receptacle 132 formed on the upper end of tubing hanger 112. The interior of sleeve 130 communicates with an axial passage 144 that extends through tree cap 128. Axial passage 144 has approximately the same inner diameter as tubing hanger passage 122.

An upper wireline retrievable crown plug 146 inserts into tree cap passage 144. Various seals can provide sealing between components within tree 100 including, for example, metal seal 148 on crown plug 146, which can engage a surface in passage 144. Dogs, or other types of locking mechanisms, can be used to lock upper crown plug 146 in place. Upper crown plug 146 is a redundant plug for further sealing passage 144, the primary seal being formed by lower plug 126. Upper crown plug 146 and lower plug 126, thus, form dual safety barriers against gas or liquids that may pass up through vertical passage 122. Any type of upper and lower plug can be used to form such safety barriers.

Cavity 150 is a space within tree 100 having a circumference defined by passage 144 and ends defined by lower plug 126 and seal 148 of crown plug 146. Cavity 150 may also include the volume associated with bores or recesses on the top of lower plug 126 or the bottom of crown plug 146. Completion fluids can be trapped in cavity 150 when upper crown plug 146 is sealed in place, which is after tree 100 is installed subsea. Once upper crown plug 146 is installed, the fluid pressure of cavity 150 will not necessarily remain at the hydrostatic pressure of the seawater surrounding tree 100.

The trapped wellbore fluids can thermally expand within cavity 150, causing an increase in pressure. Compensator 152 can be located within cavity 150 to mitigate such pressure increases. Tree 100 is one example of a wellhead assembly. Compensator 152 can be used in any type of wellhead assembly having a cavity which can contain fluids.

Figure 2:
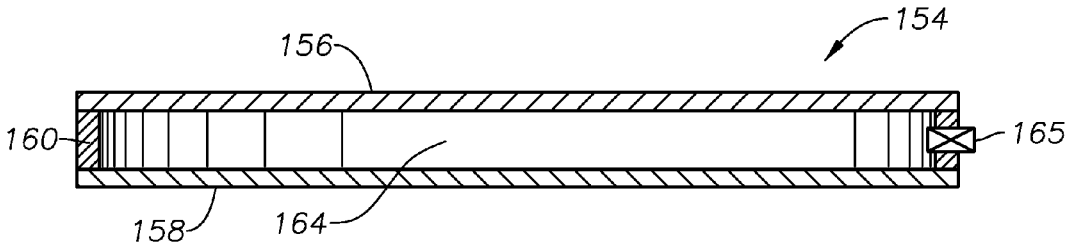
FIG. 2 is a sectional view of an embodiment of the pressure compensating device of FIG. 1, showing the plates of the pressure compensating device in a relaxed state.

Referring to FIG. 2, compensator 152 (FIG. 1) can include plate assembly 154. In one embodiment, plate assembly 154 can have a deformable member, such as upper plate 156, and a support member, such as lower plate 158. In one embodiment, the support member, such as lower plate 158, can be deformable. Similarly, in one embodiment, the deformable member, such as upper plate 156, can act as a support member. Each plate 156, 158 can be made of any of a variety of materials including, for example, metal, plastic, or polymer. Perimeter 160 can separate plate 156 from plate 158, thus defining void 164. Plates 156, 158 and perimeter 160 can be made of a unitary material or can be individual pieces that are connected to one another. Compensator 152 can be constructed such that void 164 is generally sealed and, thus, does not permit ingress or egress of gas or liquids.

Void 164 can contain a compressible fluid. The fluid can be, for example, a gas such as air, argon, or nitrogen. Alternatively, the fluid can be a liquid. In one embodiment, the liquid has a high boiling point so that it does not expand significantly when heated. Alternatively, void 164 can contain a mixture of different types of fluids including, for example, multiple gases or combinations of gas and liquid. In another embodiment, void 164 can be evacuated such that the initial pressure is below ambient pressure. Plates 156, 158 can be sufficiently rigid that they generally maintain their shape when void 164 is evacuated. Fill valve 165 can be used to evacuate fluids from void 164 and introduce fluids into void 164.

Plates 156 and 158 can be generally flat and parallel to each other. In one embodiment, plates 156 and 158 can remain generally flat and parallel to each other at a first external pressure within cavity 150. For example, the initial pressure in cavity 150, prior to thermal expansion, may be insufficient to alter the shape of plates 156 and 158, even though such initial pressure is greater than atmospheric pressure. The pressure of the fluid in void 164 or the rigidity of plates 156 and 158 can contribute to the plates remaining generally flat up to a certain external pressure. In one embodiment, the first external pressure can be the hydrostatic pressure of the seawater at the tree 100.

Figure 3:
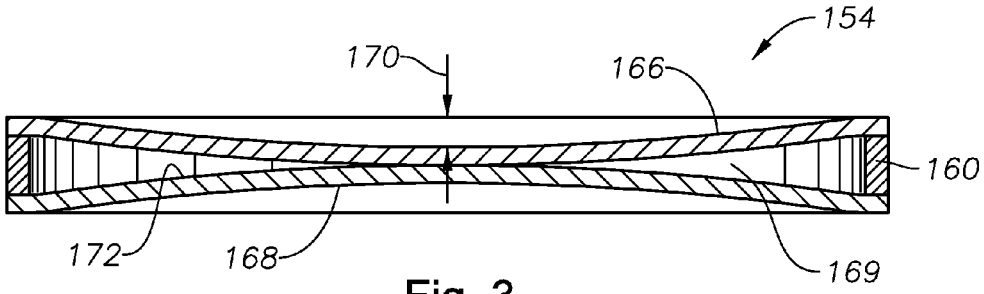
FIG. 3 is a sectional view of an embodiment of the pressure compensating device of FIG. 1, showing the plates of the pressure compensating device in a compressed state.

Referring FIG. 3, when the external pressure reaches a second pressure, plates 166 and 168 can move toward each other, thereby compressing the fluid in void 169. In the embodiment shown in FIG. 3, a portion of upper plate 166 has moved toward lower plate 168. A portion of lower plate 168 has also moved toward upper plate 166. The travel distance 170 of upper plate 166 is limited by contacting the interior surface 172 of lower plate 168. Lower plate 168 can stop the movement of upper plate 166 before upper plate 166 plastically, or permanently, deforms. Thus, the deformation of upper plate 166, through travel distance 170, is limited to elastic deformation. Likewise, a portion of lower plate 168 can move toward upper plate 166. Upper plate 166 can limit the movement of lower plate 168 to elastic deformation. Fluid in void 164 can be compressed when plates 166, 168 deflect inward toward each other. The pressure of the compressed fluid in void 164 can limit the deformation of plates 166 and 168, thereby allowing only elastic deformation.

Figure 4:
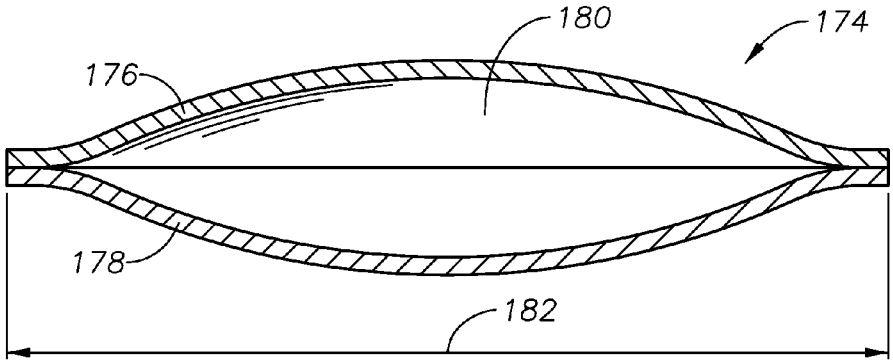
FIG. 4 is a sectional view of another embodiment of the pressure compensating device of FIG. 1, showing concave plates of the pressure compensating device in a relaxed state.

Referring to FIG. 4, in one embodiment of compensator 174, upper plate 176 and lower plate 178 can have a generally concave shape in their relaxed state. As with other embodiments, void 180 can be located between plates 176 and 178, and can be filled with a fluid. External pressure within cavity 150 (FIG. 1) on plates 176 and 178 can cause either or both plates to deflect inward, compressing any fluid located in void 180. A cylindrical ring (not shown) can be located between plates 176 and 178 to increase the volume of void 180. As with other embodiments, the movement of plates 176 and 178 can be limited to elastic deformation. In one embodiment, outer diameter 182 can increase as plates 176 and 178 are compressed. A frame, such as frame 186 (FIG. 5) or an inner diameter of cavity 150 (FIG. 1) can limit the radial expansion of outer diameter 182, thus limiting the movement of plates 176 and 178.

Figure 5:
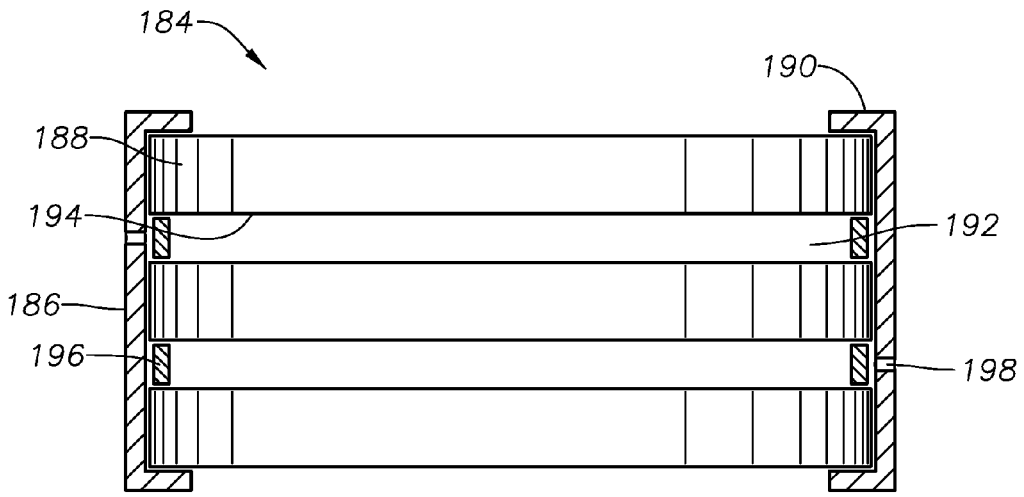
FIG. 5 is a sectional view of the pressure compensating device of FIG. 1, showing an embodiment having a frame and a plurality of pressure compensating devices.

Referring to FIG. 5, compensator assembly 184 can include frame 186 and one or more compensators 188. Frame 186 can be an apparatus that holds one or more compensators 188. Frame 186 can be, for example, a cylinder having annular retainer rings 190 for retaining compensators 188. Compensators 188 can be spaced apart within compensator assembly 184, thereby creating gaps 192 between compensators 188. Gaps 192 can allow wellbore fluid to flow between compensators 188 and, thus, the wellbore fluid can act on the outer surfaces 194 of each compensator 188. A variety of techniques can be used to establish gaps 192. For example, spacer ring 196 can be an annular ring located between each compensator 188. In one embodiment (not shown), spacers can be connected to or formed into the inner diameter of frame 186. Apertures 198 can allow wellbore fluid to pass into gaps 192. Apertures 192 can be, for example, vent holes, slots, or large openings through the sidewall rings 190 of frame 186.

Figure 6:
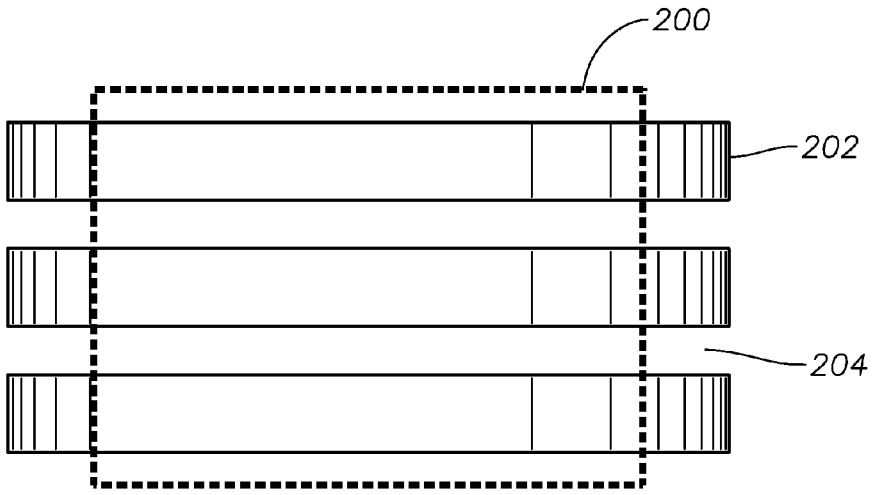
FIG. 6 is a sectional view of another embodiment of the pressure compensating device of FIG. 1, showing an embodiment having a frame and a plurality of pressure compensating devices.

Referring to FIG. 6, in one embodiment, frame 200 can include a cage for retaining compensators 202. In this embodiment, frame 200 can be wire or metal rods configured to support compensators 202 but still allow wellbore fluid to pass into gaps 204.

Referring back to FIG. 2, in operation of one embodiment, compensator 154 is assembled by connecting plates 156 and 158 to perimeter ring 160. Void 164 can be evacuated to subatmospheric pressure through valve 165, or void can remain filled with air at atmospheric pressure. Void 164 can be filled with a compressible gas. Compensator 154 can be placed directly into cavity 150 (FIG. 1), or one or more compensators 154 can be placed in frame 186 (FIG. 5), and then the assembly 184 (FIG. 5) can be placed into cavity 150. Because the tree (FIG. 1) can be located on the sea floor, the pressure inside cavity 150 can be greater than atmospheric pressure. Cavity 150 is exposed to hydrostatic pressure while crown plug 146 is being installed. In one embodiment, this initial higher pressure inside cavity 150 is not sufficient to cause significant deflection of plates 156 and 158.

Crown plug 146 (FIG. 1) can be placed in tree 100 (FIG. 1), thereby trapping fluid in cavity 150. As the temperature of the fluid in cavity 150 increases, the fluid can thermally expand, thereby increasing its volume and increasing the pressure within cavity 150. The expansion of the fluid, and the corresponding increase in pressure, can cause elastic deformation of plates 156 and 158 from a first position to a second position. The second position can put upper plate 156 axially nearer to lower plate 158. As upper plate 156 is deflected, it can compress the compressible fluid located in void 164. The space previously occupied by upper plate 156 can now be occupied by the now-expanded wellbore fluid.

Similarly, the lower plate 158 can elastically deform, toward upper plate 156, thereby compressing the fluid in void 164 and allowing the now-expanded wellbore fluid to occupy space previously occupied by lower plate 158. Because the deformation of either or both plates 156, 158 is elastic, the plates can return to their original, relaxed state when the wellbore fluid cools and contracts. Thus, the pressure within cavity 150 does not drop to a pressure significantly lower than its initial pressure.

Figure 7:
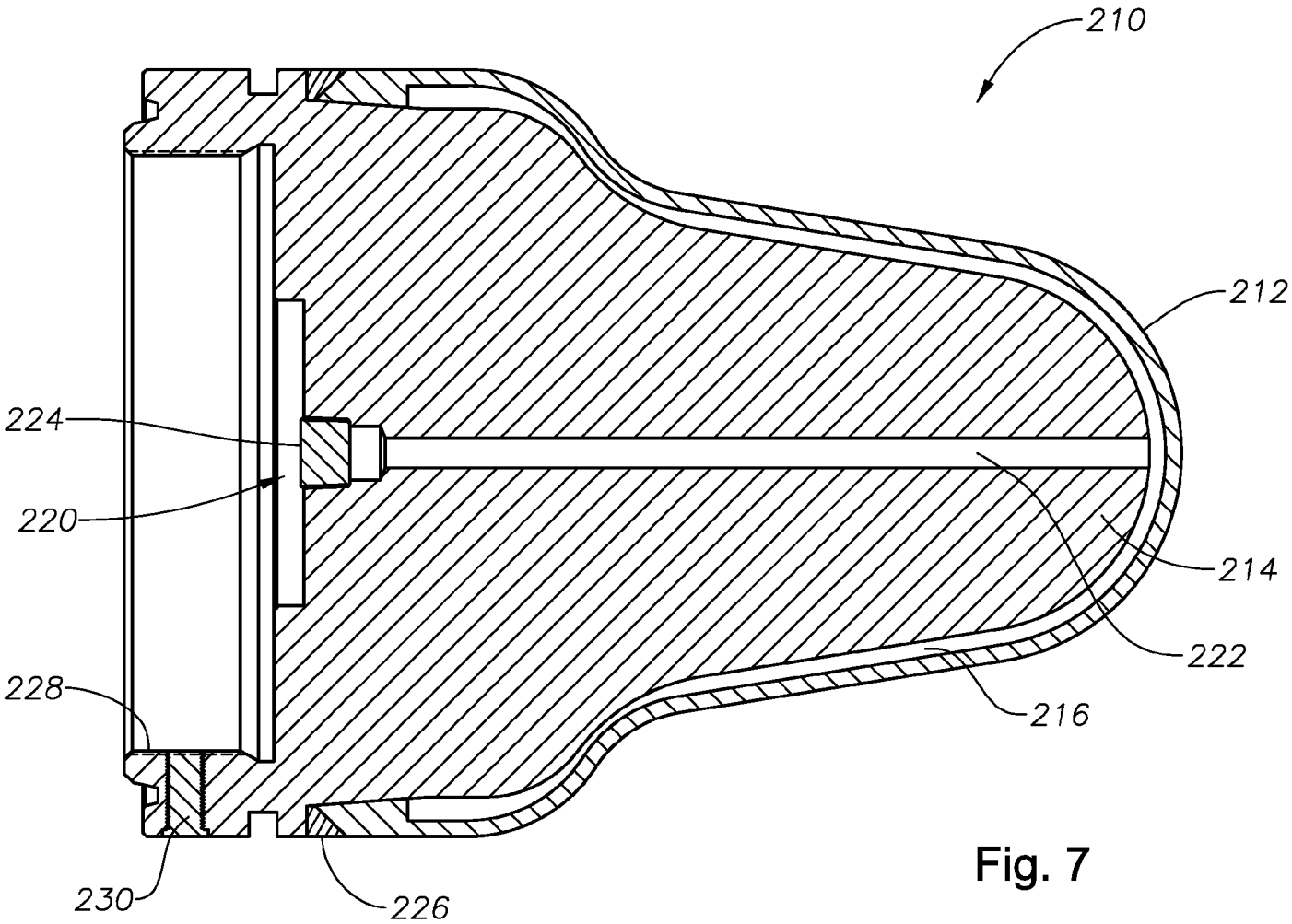
FIG. 7 is a partial sectional view of another embodiment of the pressure compensating device of FIG. 1.

Referring to FIG. 7, in another embodiment, compensator 210 can include shell 212 and bell 214. Shell 212 can be a deformable member, and bell 214 can be a support member. Shell 212 can have a bell shape in its relaxed state, wherein one end is closed and generally rounded, and the body gradually becomes larger toward the other end. Bell 214 can be generally solid and have a contour on its exterior surface that is similar to the contour on the interior surface of shell 212. Bell 214 can be coaxially nested within shell 212 to define gap 216 between them. Gap 216 can be filled with a compressible fluid. Port 220 can be used to introduce fluid into gap 216. In one embodiment, passage 222 can communicate the fluid from port 220 to gap 216. Plug 224 can be inserted into port 220 to seal port 220 from fluid located on the exterior of compensator 210. In one embodiment, plug 224 can be a check valve that can be used to introduce the compressible fluid into gap 216.

Shell 212 and bell 214 can be joined by any of a variety of techniques. In one embodiment, joint 226 can be a weld, wherein shell 212 and bell 214 are welded together to form a seal. In other embodiments (not shown), joint 226 can include, for example, adhesive seals, threaded connections, and elastomeric seals. In the welded embodiment, port 220 can remain unsealed during the welding process to allow fumes from gap 216 to escape.

Compensator 210 can be introduced into cavity 150 (FIG. 1) by any technique. In one embodiment, compensator 210 can be lowered on a wireline or a running tool. In another embodiment, compensator 210 can be connected to one of the crown plugs 126, 146 (FIG. 1) and run into cavity 150 when the crown plug 126, 146 is used to seal an end of cavity 150. For example, threads 228 can be located on an inner diameter surface of shell 212 and can be connected to threads (not shown) on upper crown plug 146 (FIG. 1). Set screw 230, or grub screw, can be used to prevent compensator 210 from rotating relative to the member to which it is attached, such as crown plug 126 or 146. Alternatively, compensator 210 can be integrally formed with a crown plug (not shown) or connected by another technique such as bolts, pins, or welding.

In operation of one embodiment of compensator 210, gas can be introduced into gap 216, through plug 224, which can be a check-valve plug, to pressurize gap 216 to a pressure that is greater than atmospheric pressure. The pressure can be selected to support shell 212, such that shell 212 does not deform due to the hydrostatic pressure in cavity 150, but still allow shell 212 to elastically deform when the pressure in cavity 150 increases to a predetermined level above hydrostatic pressure.

Compensator 210 can then be connected to upper crown plug 146 via threads 228, secured against rotation by set screw 230, and lowered into cavity 150 (FIG. 1) when upper crown plug 146 is set into place. As increased temperatures within wellhead 100 cause the completion fluid pressure to increase, the completion fluid can cause shell 212 to elastically deform inward, toward bell 214. Shell 212 can deflect to be nearer bell 214. In one embodiment, the deflection can include an axial deflection, a radial deflection, or both an axial and a radial deflection, depending on the shape of shell 212. The fluid in gap 216 can be compressed when shell 212 deforms inward. Bell 214 provides support to shell 212, thereby limiting its travel distance and preventing plastic deformation of shell 212.

While the invention has been shown or described in only some of its forms, it should be apparent to those skilled in the art that it is not so limited, but is susceptible to various changes without departing from the scope of the invention.

What is claimed is:

1. A wellhead assembly comprising:

a cylindrical bore;

a first plug located in and sealingly engaging the cylindrical bore;

a second plug located in and sealingly engaging the cylindrical bore, the second plug being spaced axially apart from the first plug, wherein the cylindrical bore, the first plug, and the second plug define a wellhead cavity, the wellhead cavity being adopted to retain a trapped fluid between the first and second plug; and an apparatus disposed within the wellhead cavity for mitigating pressure in the wellhead cavity in respond to temperature changes of the trapped fluid, the apparatus comprising;

a deformable member and a support member located within the wellhead cavity, the deformable member and the support member defining a seal void between them;

a compressible fluid located within the sealed void; and the deformable member being inwardly deflectable toward the support member in response to a pressure increase in the wellhead cavity.

2. The wellhead assembly according to claim 1, wherein the inward deflection of the deformable member is limited by the support member such that the inward deflection of the deformable member remains elastic.

3. The wellhead assembly according to claim 1, wherein the support member inwardly deflects toward the deformable member in response to the pressure increase in the wellhead cavity and the inward deflection of the support member is limited by contact with the deformable member within the sealed void.

4. The wellhead assembly according to claim 1, wherein the deformable member has a bell shape in a relaxed state, the bell shape defined by a first end that is closed and generally rounded, and a second end opposite the first end that is larger in diameter than the first end, and a curved a transition between the first end and the and second end.

5. The wellhead assembly according to claim 1, wherein the deformable member has a concave surface when in a relaxed state.

6. The wellhead assembly according to claim 1, wherein the deformable member is generally flat when in a relaxed state.

7. The wellhead assembly according to claim 1, wherein the deformable member and the support member are each comprised of one of metal, polymer, and elastomer.

8. The wellhead assembly according to claim 1, wherein the compressible fluid comprises a gas.

9. The wellhead assembly according to claim 1, wherein the deformable member and the support member are located within a frame, the frame having a sidewall with at least one sealable aperture in the sidewall.

10. The wellhead assembly according to claim 9, further comprising a compensator including a pair of plates located within the frame.

11. The wellhead assembly according to claim 1, wherein the apparatus is connected to the first plug.

12. A method for mitigating pressure in a subsea wellhead member, the method comprising:

(a) connecting a deformable member to a support member to define a sealed void internally between them;

(b) filling the sealed void with a compressible fluid;

(c) placing the deformable member and the support member in a confined space in the subsea wellhead member;

(d) allowing a second fluid to enter the confined space to externally engage the deformable member;

(e) sealing the confined space from seawater on the exterior of the subsea wellhead member with at least one plug; and (f) thermally expanding the second fluid in the confined space by flowing a well fluid through the wellhead member such that the second fluid elastically deforms the deformable member toward the sealed void and thereby displaces the deformable member from a first position to a second position, the second position being nearer the support member than the first position, the second fluid occupying the space previously occupied by the support member.

13. The method according to claim 12, wherein the second fluid is at a first pressure prior to thermal expansion, the first pressure being greater than atmospheric pressure, and the second fluid is at a second pressure after thermal expansion, the second pressure being greater than the first pressure, and wherein the first pressure does not cause displacement of the deformable member and wherein the second pressure does cause displacement of the deformable member.

14. The method according to claim 12, wherein in the second position, the deformable member contacts the support member and the support member limits further displacement of the deformable member.

15. The method according to claim 12, wherein the deformable member has a bell shape in a relaxed state, the bell shape defined by a first end that is closed and generally rounded, and a second end opposite the first end that is larger in diameter than the first end, and a curved transition between the first end and the and second end, the deformable member defining a first contour on an interior surface and the support member has a second contour on an exterior surface, the second contour being similar to the first contour.

16. The method according to claim 12, further comprising the step of contracting the second fluid by flowing the well fluid through the wellhead member, wherein the deformable member returns to the first position.

17. The method according to claim 12, further comprising the step of placing the deformable member and the support member in a frame and step (c) comprises placing the frame in the subsea wellhead member.

18. An apparatus for mitigating pressure changes in a trapped liquid cavity of a subsea wellhead member comprising:

a cylindrical wellhead housing defining the trapped liquid cavity therein;

a first pair of plates and a second pair of plates within the cylindrical wellhead housing, each pair of plates comprising a first plate and a second plate, the the first plate and the second plate being spaced apart from each other, defining a void between them and being deflectable toward each other;

a compressible fluid located within the void; and wherein inward deflection of the first plate and second plate of each of the first pair of plates and the second pair of plates in response to an increase in pressure in the trapped liquid cavity is limited by contact of the first plate and second plate of the first pair of plates with each other and by contact of the first plate and the second plate of the second pair of plates with each other, such that the inward deflection remains elastic.

19. The apparatus according to claim 18, wherein the pair of plates comprises a cylindrical ring connecting the first plate and second plate and defining an outer diameter of the void.

20. The apparatus according to claim 18, wherein the first plate has a flat surface in relaxed state.

* * * * *